US006176497B1

(12) United States Patent
Bonaventure

(10) Patent No.: US 6,176,497 B1
(45) Date of Patent: Jan. 23, 2001

(54) IN-LINE SKATE FRAME WITH INDEPENDENT LATERAL FLANGES

(75) Inventor: Laurent Bonaventure, Cran Gevrier (FR)

(73) Assignee: Salomon S.A., Metz-Tessy (FR)

( * ) Notice: Under 35 U.S.C. 154(b), the term of this patent shall be extended for 0 days.

(21) Appl. No.: 09/420,833

(22) Filed: Oct. 19, 1999

(30) Foreign Application Priority Data

Oct. 20, 1998 (FR) ..... 98 13400

(51) Int. Cl.[7] ..... A63C 1/00
(52) U.S. Cl. ..... 280/11.27; 280/11.223
(58) Field of Search ..... 280/11.27, 11.22, 280/11.23, 11.19, 11.3, 7.13, 11.223, 11.221, 11.233

(56) References Cited

U.S. PATENT DOCUMENTS

| | | | | |
|---|---|---|---|---|
| D. 401,657 | * | 11/1998 | Ou . | |
| 578,081 | | 3/1897 | Gibbs et al. . | |
| 593,278 | | 11/1897 | Moulton . | |
| 2,168,820 | | 8/1939 | Edstrom | 280/11.23 |
| 3,387,852 | | 6/1968 | De Sarro | 280/11.2 |
| 5,129,663 | * | 7/1992 | Soo | 280/11.22 X |
| 5,380,020 | | 1/1995 | Arney et al. | 280/11.22 |
| 5,388,846 | | 2/1995 | Gierveld | 280/11.22 |
| 5,533,740 | * | 7/1996 | Lin | 280/11.22 |
| 5,549,310 | | 8/1996 | Meibock et al. | 280/11.22 |
| 5,645,287 | | 7/1997 | Soo | 280/11.2 |
| 5,720,488 | | 2/1998 | Foffano et al. | 280/11.22 |
| 5,775,706 | | 7/1998 | Caeran | 280/11.22 |
| 5,803,466 | | 9/1998 | Wrike | 280/7.13 |
| 5,873,584 | * | 2/1999 | Wrike | 280/11.22 |
| 5,908,196 | * | 6/1999 | Weiss | 280/11.19 |
| 5,915,703 | * | 6/1999 | Wrike | 280/11.22 |
| 6,045,143 | * | 4/2000 | Wrike | 280/11.22 |
| 6,047,972 | * | 4/2000 | Rudolph | 280/11.19 |

FOREIGN PATENT DOCUMENTS

| | | |
|---|---|---|
| 29612212 U | 12/1996 | (DE) . |
| 0774283 | 5/1997 | (EP) . |
| 0795347 | 9/1997 | (EP) . |
| 2767709 | 3/1999 | (FR) . |
| 18312 | of 1892 | (GB) . |
| WO95/13120 | 5/1995 | (WO) . |
| WO96/22818 | 8/1996 | (WO) . |
| WO96/26775 | 9/1996 | (WO) . |
| WO97/02072 | 1/1997 | (WO) . |
| WO97/33665 | 9/1997 | (WO) . |
| WO97/33666 | 9/1997 | (WO) . |
| WO98/33565 | 8/1998 | (WO) . |

* cited by examiner

*Primary Examiner*—Brian L. Johnson
*Assistant Examiner*—Bryan Fischmann
(74) *Attorney, Agent, or Firm*—Greenblum & Bernstein, P.L.C.

(57) ABSTRACT

An in-line skate frame that has a main body with a transverse base equipped with at least one support surface at the toe of the boot, one support surface at the heel of the boot, two projecting lateral portions that extend the transverse base downward, and two flange portions which are adapted to receive a series of wheels. The flange portions are independent attached elements connected to the projecting lateral portions of the main body. The two projecting lateral portions each have at least one fitting formed by a groove serving as the housing of at least one zone of each flange portion, each groove being bordered by an outer wall of the projecting lateral portion and by a bracing portion common to both grooves, laterally spaced apart from one another. A frame of this type has improved properties of strength and flexural and torsional rigidity, while being simple and economical to assemble.

32 Claims, 3 Drawing Sheets

Fig. 2
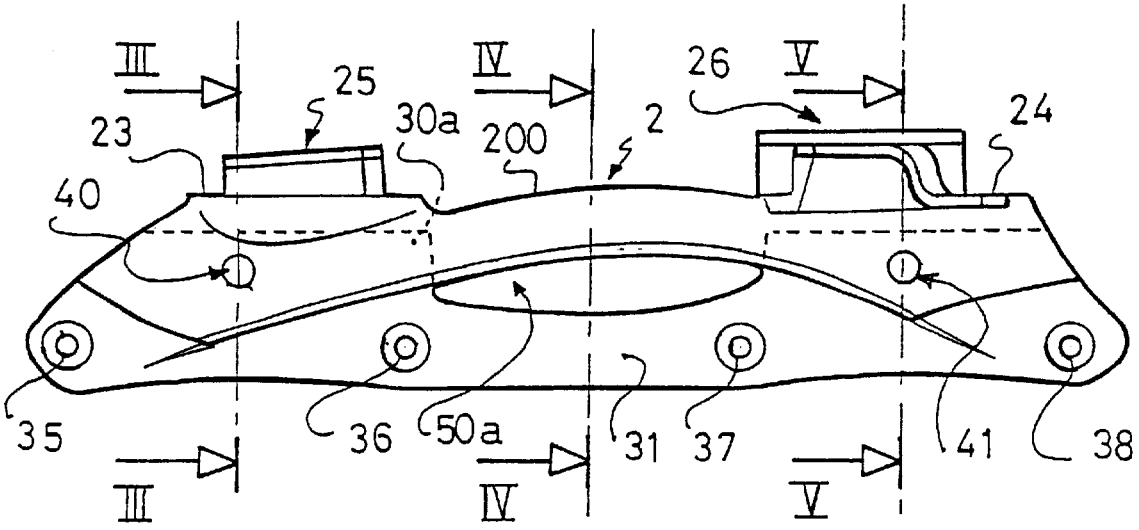
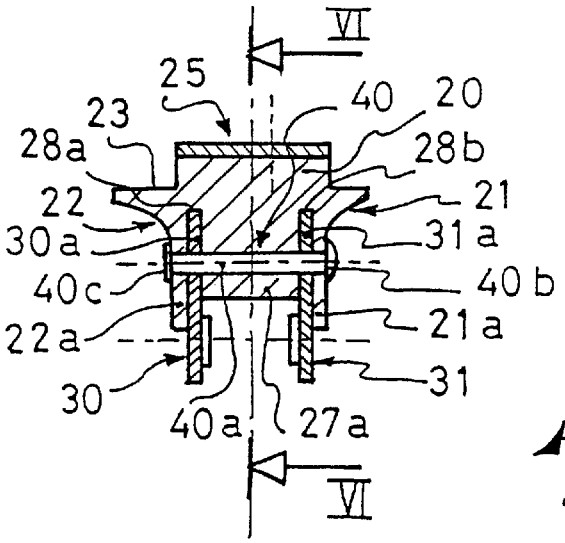
Fig. 3

IN-LINE SKATE FRAME WITH INDEPENDENT LATERAL FLANGES

BACKGROUND OF THE INVENTION

1. Field of the Invention

The invention relates to the field of the in-line roller skates. It relates more particularly to an improved frame for the practice of in-line skating.

2. Description of Background and Material Information

An in-line skate normally has an assembly of several basic elements, including a boot which is attached to a frame that supports a series of aligned wheels. The frame therefore forms the interface between the boot and the wheels. The frame generally includes bridges that receive the boot, these bridges connecting lateral walls serving as supports for the wheels. The frame sustains flexural and torsional stresses that are applied by the skater. It must therefore have sufficient rigidity properties to maintain a correct alignment of the wheels in both the horizontal plane and the vertical plane, in order to prevent sagging, twisting or even lateral deformation during turns.

Various types of frames currently exist. The frames that are the most rigid, but also the most expensive to manufacture, are the frames extruded and machined from a metal section, generally made of aluminum. Thus, a monoblock piece of great rigidity is obtained, which is particularly adapted for competition. The process for producing such frames is described in U.S. Pat. No. 5,388,846, for example. In addition to the cost, there are other drawbacks tied to the monolithic nature of the frame, which provides few possibilities for adjusting the mechanical properties and does not make the frame very shock absorbent.

European Patent Publication No. 0 774 283 discloses a frame that includes separate lateral flanges obtained by stamping sheet metal, then joined by bridges. The desired rigidity is provided by a rib of the frame with a predetermined dimension and position. The production of such a frame nevertheless remains relatively high-cost as a result of the shaping operations and high aluminum consumption.

Also well known are the frames formed of two half-pieces made of injected plastic, joined to one another by complementary fastening means. In general, these frames are more economical to produce; however, they have mediocre mechanical properties.

International Patent Publication No. WO 98/33565 relates to an in-line skate that includes an interface piece arranged between the frame and the boot. The interface piece is attached to the side of the frame by connecting points located between the wheel axles and the bridges of the frame. This structure has the advantage of improving the transfer of forces between the boot and the frame. A structure of this type is nevertheless complicated and expensive to produce since it requires the design of an additional interface piece and a frame made entirely of metal. The excessive thicknesses created between the frame and the interface also have a tendency to elevate the boot with respect to a traditional structure, which is undesirable. These excessive thicknesses also increase the material cost and make the skate heavier.

European Patent Publication No. 0 795 347 discloses a frame that includes two longitudinally spaced blocks joined to one another by sliding lateral rails. A structure of this type allows the length of the frame to be adjusted depending on different shoe sizes. However, such a frame has mediocre rigidity due to the design of the frame in two separate blocks.

U.S. Pat. No. 5,775,706 relates to a skate assembly that includes a boot, a frame having crosswise reinforcing elements and a pair of reinforcing angle brackets connecting the front and rear axes of the frame to the sides of the boot. A structure of this type promotes the transmission of stresses from the boot to the wheels. However, this structure has the drawback of being complex to produce and assemble. Moreover, a structure of this type is not adapted for being associated with a system for rapidly detaching the boot from the frame.

International Patent Publication No. WO 97/33665 relates to a frame for gliding sport articles whose structure includes parts made from materials with different mechanical properties attached to one another at least partially.

U.S. Pat. No. 5,803,466 relates to an in-line skate that includes a frame equipped with a toe plate and a heel plate of the boot, to which independent lateral flanges are detachably attached. The flanges are inserted through two cavities laterally spaced apart and demarcated on each side of the frame by two pairs of edges extending downward from the lower surface of each plate. One of the primary advantages is being able to separate the flanges from the rest of the frame in order to replace them or interchange them. Another advantage is to offer a structure with intermediate plates that favors the weight distribution so as to reinforce the rigidity and strength of the frame. However, a structure of this type does not provide optimal mechanical properties due to the fact that the flanges are only held in place by edges and are locked independently by means of independent screws. Furthermore, the assembly of such a frame is lengthy and not very economical because of the large number of elements, particularly fastening pieces.

Various other frame designs are described in the following documents: UK 18,312; U.S. Pat. No. 578,081; U.S. Pat. No. 593,278; U.S. Pat. No. 2,168,820; U.S. Pat. No. 3,387,852; U.S. Pat. No. 5,380,020; WO 96/22818; U.S. Pat. No. 5,549,310; WO 97/02072; DE 296 12 212 U1; and WO 96/26775. However, all these structures are clearly differentiated from the one offered by the present invention.

SUMMARY OF THE INVENTION

The invention therefore has an object of offering a frame structure that solves the problems of the prior art that have just been described.

In particular, one of the objects of the invention is to propose a frame having good mechanical properties, particularly good strength and good flexural and torsional rigidity, and promoting an optimal transmission of forces during the practice of skating.

Another object of the invention is to propose a frame whose very design makes it possible to vary the mechanical properties by varying the nature of the materials and the dimensions of the elements that constitute it.

Another object of the invention is to propose a frame having good mechanical characteristics while limiting both the number of elements involved in its construction and the bulkiness, and also limiting the use of expensive materials, saving them for the most appropriate places.

Another object of the invention is to propose a frame that is capable of adapting to any boot coupling system, particularly any detachable coupling system.

Another object of the invention is to propose a frame designed to be both light and without excessive thickness, but also rigid and inexpensive.

Another object of the invention is to propose an easy-to-assemble frame requiring a minimum of operations.

Another object of the invention is to propose the capability to facilitate the adaptation of the frame to several boot sizes and hence to limit the number of pieces to be produced, thus reducing production costs.

To this end, the invention relates to an in-line skate frame that includes a generally U-shaped main body with a transverse base equipped with at least one support bridge at the toe of the boot and one support bridge at the heel of the boot; and two projecting lateral portions that extend the transverse base downward, and two flange portions arranged parallel to one another including means adapted for receiving a series of wheels, the flange portions being independent attached elements connected to the projecting lateral portions of the main body.

According to an essential characteristic of the invention, two projecting lateral portions, each including a fitting formed by a groove serving as the housing of at least one zone of each flange portion, each groove being laterally bordered by the outer wall of the projecting lateral portion and by a bracing portion common to both grooves, laterally spaced apart from one another.

According to a second essential characteristic, the outer walls of the projecting portions, the zones of the flange portions and the bracing portion are equipped with coaxial holes that allow the passage of a fastening means formed by a pin portion passing through the holes across at least the width of the two flange portions.

The invention has the advantage of simultaneously providing good flexural and torsional rigidity, good lateral transmission of stresses, and lightness without any excessive thickness of material. The configuration of fittings separated by a solid bracing portion and associated with a linkage means passing through the frame from part to part contributes to an increase in the strength and the rigidity of the frame with respect to the known assemblies of prior art.

The efficiency of the transfer of forces between the boot and the wheels is also greatly improved by such a configuration. In particular, the bracing portion allows a better transverse distribution of forces. A substantial force transmitted to one of the sides of the boot is more evenly distributed over the two flanges, thus reducing the risk of excessive deformation of one of the flanges of the frame.

Moreover, a general frame structure of this type offers great modularity, i.e., the possibility to choose, during assembly, the materials and the dimensions that are suitable for producing, in the appropriate places, the parts constituting the frame.

According to another characteristic of the invention, each flange portion includes a front zone and a rear zone, respectively joined to its projecting lateral portion by a front fitting and a rear fitting.

According to another characteristic of the invention, the front zone and the rear zone of each flange portion are fastened by two fastening means longitudinally spaced apart from one another, each formed by a single pin simultaneously serving to connect the front zones and the rear zones of the flange portions.

BRIEF DESCRIPTION OF DRAWINGS

The present invention also encompasses other characteristics and advantages, which will emerge from the attached drawings, according to which:

FIG. 2 is a side view of the frame of FIG. 1;

FIG. 3 is a cross-sectional view along the line III—III of FIG. 2;

DETAILED DESCRIPTION OF THE INVENTION

Figure 1:
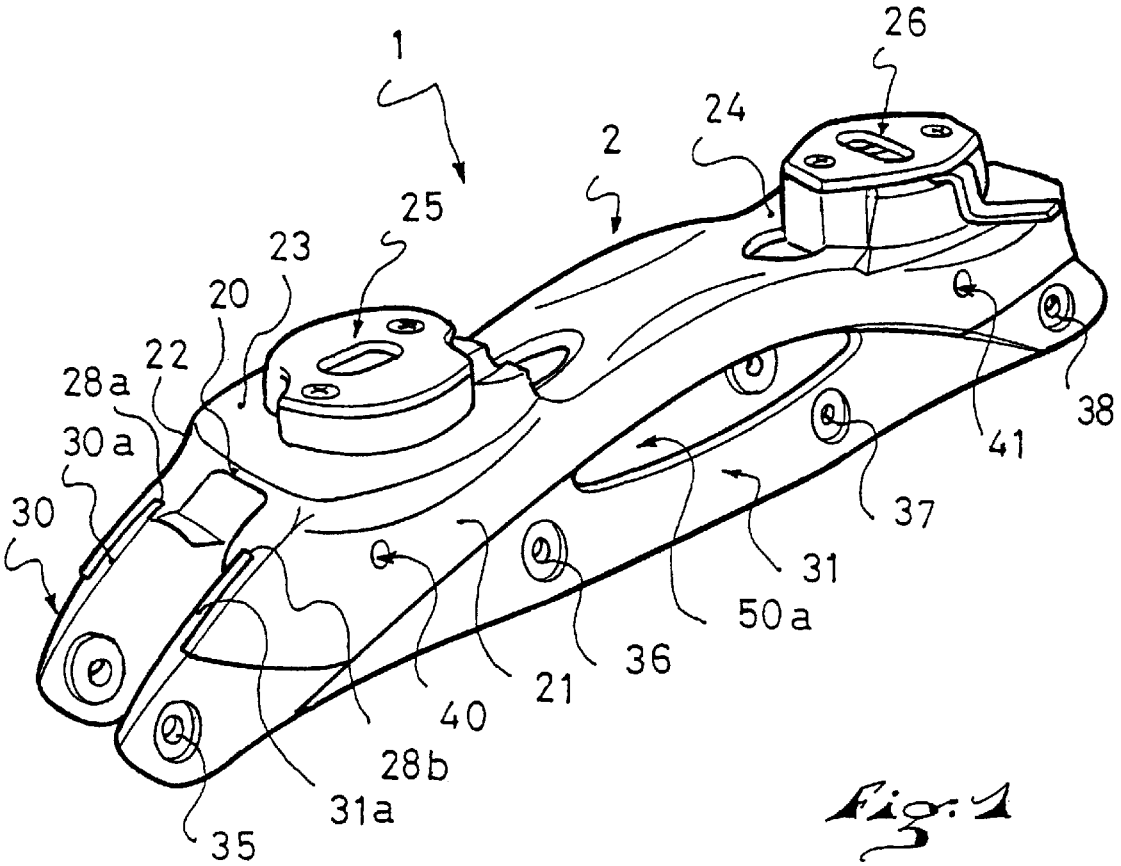
FIG. 1 is a perspective view of a frame according to the invention.
Figure 4:
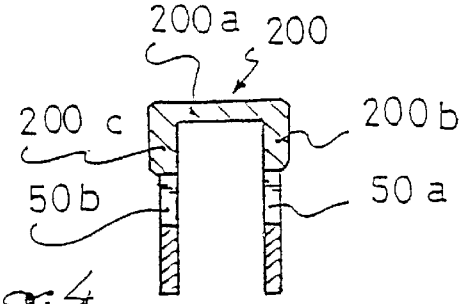
FIG. 4 is a cross-sectional view along the line IV—IV of FIG. 2.

The frame 1 of the invention includes a main body 2 that generally has, in cross section, an inverted U-shape. The U-shape preferably extends along the entire length of the body in order to provide good flexural and torsional rigidity to the body itself. However, this shape may extend along only one longitudinal part of the body, for example, in the zones for receiving the boot.

The main body 2 includes a transverse base 20, which represents the base of the U-shaped section. Two lateral downwardly projecting portions 21, 22, which represent the legs of the U-shaped profile, extend vertically and downward from this base. The lateral portions 21, 22 are substantially parallel to one another.

The transverse base includes support surfaces 23, 24 for receiving the sole of a boot (not represented). These surfaces consist in a toe support surface 23 and a heel support surface 24. Front 25 and rear 26 locking mechanisms of the detachable type extend upward from the support surfaces 23, 24, respectively. These locking mechanisms are adapted for being associated with complementary fastening elements provided in the boot (not shown). French Patent Publication No. 2 772 627, published on Jun. 25, 1999, describes in detail the particular fast linkage system that is recommended within the scope of the present invention. The disclosure of French Patent Publication No. 2 772 627 is incorporated-by-reference in its, entirety, therefore, without it being necessary to further describe or summarize the disclosure of same in detail.

Other systems for fastening the boot to the frame are also within the scope of the invention. A traditional linkage device with two center screws, one front, one rear, can also replace the fast fastening system. In this case, the screws pass through bores provided through the transverse base of the frame and are anchored into the sole of the boot as known from prior art.

The frame includes two flange portions 30, 31 arranged parallel with respect to one another, which laterally extend the main body downward. These flange portions are independent elements in the sense that they are not directly connected to one another, and are not in one piece with the body of the frame but are attached to the body separately. The two portions 30, 31 are joined to the lateral portions 21, 22 of the body.

The flange portions 30, 31 are each equipped with a series of longitudinally aligned holes 35, 36, 37, 38. The two series of holes are arranged so that when the flange portions are mounted on the body, the holes are opposite one another in pairs, and hence are in coaxial alignment, thus allowing the transverse passage of a wheel axle.

The flange portions 30, 31 are preferably portions of simple design in the form of plates, for purposes of flat ease and production costs, as well as for purposes of ease of assembly. The body 2 itself is a section of more complex shape.

As shown in FIGS. 2 and 3, the flange portions 30, 31 are joined to the respective downwardly projecting lateral portions 21, 22 at front zones 30*a*, 31*a*. Each zone 30*a*, 31*a* is guided in a front groove 28*a*, 28*b* of complementary shape obtained in the main body. The front grooves 28*a*, 28*b* are oriented along a plane coinciding with a plane of each projecting portion, generally substantially vertical and perpendicular to the support surface 23 of the base. The fitting essentially contributes to the lateral torsional and deformational rigidity of the frame. For this reason, the first front groove 28*a* is bordered by the outer wall 22*a* of the downwardly projecting lateral portion 22, and by a center bracing portion 27*a*. Likewise, the second front groove 28*b* is bordered by the outer wall 21*a* of the downwardly projecting lateral portion 21 and by the center bracing portion 27*a*. The center portion 27*a* is therefore common to both grooves. Such a configuration promotes the lateral support and the torsional support of the flange portions by providing a solid transverse block across the entire width of the frame in the linkage zones of the flange portions. The block also allows better transmission and better distribution of stresses in the flange portions.

Figure 5:
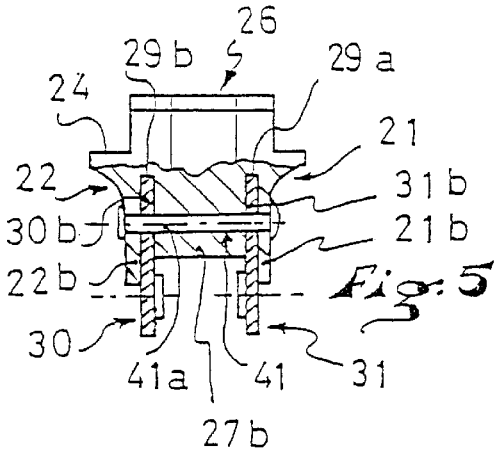
FIG. 5 is a cross-sectional view along the line V—V of FIG. 2.

Similarly, as shown in FIG. 5, the flange portions 30, 31 are joined to the projecting portions 21, 22, respectively, by means of a second fitting into which the rear zone 30*b*, 31*b* of each flange portion is inserted. Each zone 30*b*, 31*b* is guided in a rear groove 29*a*, 29*b* of complementary shape provided in the main body. The rear grooves 29*a*, 29*b* are also oriented in an insertion plane corresponding to the extension plane of each projecting portion, generally substantially vertical and perpendicular to the heel support surface 24 of the base. The first rear groove 29*a* is bordered by the outer wall 21*b* of the projecting portion 21, and by a second center bracing portion 27*b*. Likewise, the second rear groove 29*b* is bordered by the outer wall 22*b* of the projecting portion 22 and by the center bracing portion 27*b*. The center portion 27*b* is therefore common to both rear grooves 29*a*, 29*b*. The same advantageous effects of strength, rigidity, and distribution of forces are thus obtained at the rear of the frame.

It could be provided for the fitting to extend along the entire length of the body. In that case, the first front 28*a* and rear 29*a* grooves, and the second front 28*b* and rear 29*b* grooves, respectively, located on the same side are joined together to form only two parallel grooves extending continuously along the frame. In that case, it is preferable for one bracing portion to extend along the entire length of the frame. The disadvantage of such a structure can result from the space reserved for the placement of the wheels. Because of this, a structure like the one represented, in which the bracing portions are discontinuous and preferably arranged vertical to the center distance of axles between two wheels, is preferred.

The joining of the flange portions 30, 31 is obtained by fastening elements 40, 41, longitudinally separated from one another, whose function is to lock the flange portions according to the sliding plane into the fitting formed by the groove; in other words, a substantially vertical plane oriented longitudinally.

Hence, one fastening element is provided at the front and another 41 is provided at the rear of the frame. More precisely, the fastening element 40 is preferably provided in approximate vertical alignment with the median point of the center distance of axles of the front wheels, corresponding to the two first front holes 35, 36, so as not to interfere with the mounting of wheels of different diameters. Likewise, the rear connection point 41 is located in the vertical alignment with the median point of the center distance of axles of the rear wheels, corresponding to the two rear holes 37, 38.

As shown in detail in FIG. 3, the front fastening element 40 includes a pin portion 40*a* that passes transversely through a series of coaxial holes, formed in the first outer wall 22*a*, in the front zone 30*b* of the flange portion 30, in the bracing portion 27*a*, in the second front zone 31*a* of the flange portion 31 and in the second outer wall 21*a* of the projecting portion 21, respectively. In other words, the pin passes through the frame across its entire width in the front fitting zones of the flange portions with the main body. The flange portions 30, 31 are thus simultaneously locked to the front by a single fastening element. The fastening therefore has improved strength and simplicity.

Similarly, the rear zones 30*b*, 31*b* of the flange portions 30, 31 are fastened to the main body by a rear fastening element 41 of the same type as the element 40. Thus, the rear fastening element 41 includes a pin portion 41*a* that passes transversely through a series of coaxial holes, formed in the first outer wall 22*b*, in the rear zone 30*b* of the flange portion 30, in the bracing portion 27*b*, in the second rear zone 31*b* of the flange portion 31 and in the second outer wall 21*b* of the projecting portion 21, respectively.

Figure 6:
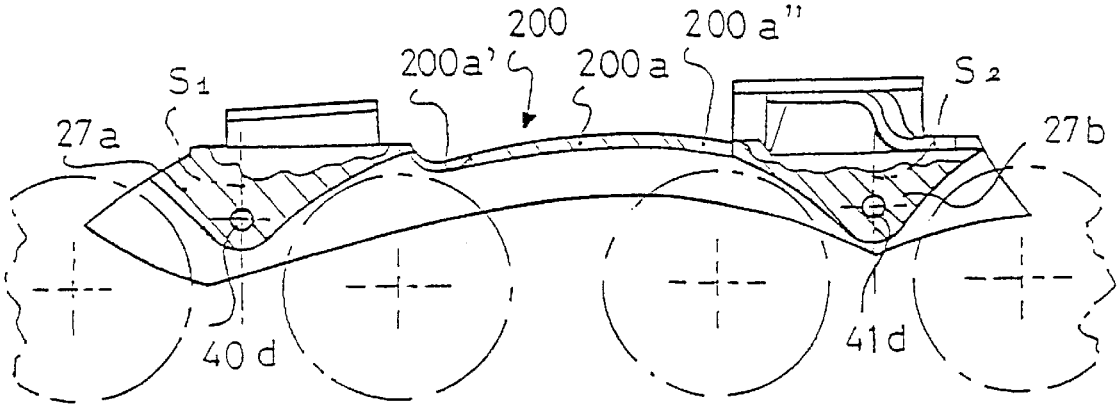
FIG. 6 is a longitudinal cross-sectional view along the line VI—VI of FIG. 3.

As shown in the cross-sectional view in FIG. 6, the front bracing portion 27*a* and the rear bracing portion 27*b* are preferably separated from one another. The shape of the bracing portions 27*a*, 27*b* is adapted so as to allow the free rotation of the wheels, appearing in FIG. 6 in broken lines. Thus, the portions have a transverse cross section that tends to decrease from a maximal section $S_1$, $S_2$ located substantially at the level of the fastening axis 40*d*, 41*d*. The longitudinal contour of the intermediate portions is therefore preferably concave so as to provide a progressive decrease in the cross section on both sides of the section $S_1$, $S_2$. Thus, sufficient support of the flange portions is obtained, which strengthens the entire frame while retaining a frame that is lightweight without using excess material. At the center of the frame, however, despite a minimal material thickness in order to limit the weight, the U-shaped profile of the intermediate portion 200 makes it possible to retain good rigidity, particularly in the torsional forces between the front and the rear of the frame.

The two fastening elements can be either permanent or detachable. In the case of permanent elements, i.e., elements which cannot be removed without the aid of special tools and which in all cases cannot be reused, it is preferable to use rivets. FIG. 3 shows the mounting of a rivet that includes the pin portion 40*a*, which ends at one end in an enlarged head 40*b*, and at the opposite end in a snapped portion 40*c*. The second fastening element 41 can be identical to the element 40.

The detachable fastening element can be any element that can be detached by an adapted tool, such as a key, and that can allow the separation of the joined elements without there being any destruction of the fastening element. In that case, the use of screws, such as Allen screws or Torx® screws, is preferred.

It is to be understood that such an assembly is particularly easy to assemble. since it does not require any bonding, welding or similar operation. The number of elements is limited to a strict minimum without thereby affecting the mechanical strength properties of the assembly.

According to the invention, the main body includes an intermediate portion 200 having a longitudinal convex arc shape and an upside-down U-shaped cross-section. Thus, the intermediate portion has the shape of a girder that includes a base wall 200*a* extended laterally by side walls 200*b*, 200*c*. The intermediate portion integrally connects the two boot support surfaces 23, 24 to one another so as to increase the rigidity of the frame. The intermediate portion 200 is vertically separated from each flange portion 30, 31 by a lateral opening 50*a*, 50*b*, which helps to make the frame lighter. Likewise, openings 200*a*', 200*a*" of the intermediate portion can be provided in the base wall 200*a*.

One of the advantages of the invention is that it offers the possibility to obtain the body 2 and the flange portions 30, 31 from materials of different types and different mechanical properties. In particular, the main body is preferably formed of a hard plastic material, such as polypropylene, polyamide, polyethylene, or the like. The plastic can be reinforced with fibers, such as short carbon or glass fibers. The body can be produced by injection molding one part or several attached parts. Given that the flange portions must support the wheel axles, the portions are preferably made of a material with a higher modulus of elasticity than the modulus of elasticity of the material composing the main body. Preferably, these portions are made of metal or plastic-based material reinforced by mineral or organic fibers. Even more preferably, the flange portions are formed of cut or machined plates or sections of aluminum or aluminum alloy. The plates can be subjected to stamping operations creating particular shapes, such as reinforcing ribs, for example. Aluminum or aluminum alloys offer the advantage of having a favorable modulus-to-weight ratio and of being easily formed from plates of different thicknesses.

Another advantageous characteristic of the invention consists of providing for the adaptation of identical flange portions to bodies of variable size in order to allow the frame to be adapted to different boot sizes in a more economical and rational way.

Figure 7:
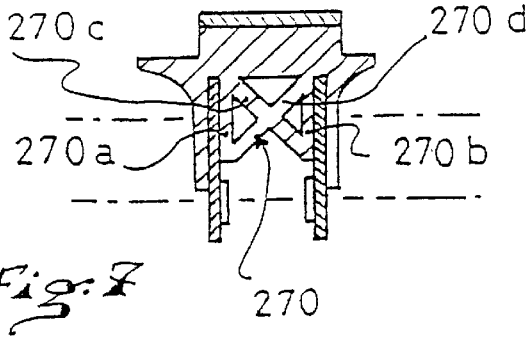
FIG. 7 is a cross-sectional view along III—III of FIG. 2 within the scope of an alternative embodiment.

FIG. 7 shows a variant of the structure of the main body of the frame. In this particular case, the intermediate bracing portion 270 includes opposing vertical lateral walls 270*a*, 270*b* that internally border the grooves. The lateral walls are reinforced by diagonal walls 270*c*, 270*d* forming an X-shaped profile section. It is therefore designed so that the intermediate portion has the effect of reinforcing the lateral and torsional support of the frame without being a portion of solid material. A reinforcing section of this type has the advantage of making the frame lighter while retaining the benefits in terms of strength, rigidity, and transmission of forces.

Figure 8:
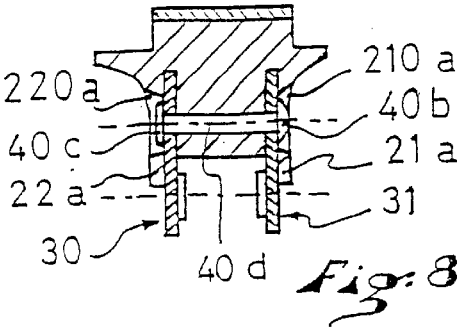
FIG. 8 is a cross-sectional view along III—III of FIG. 2 within the scope of a second alternative of the invention.

FIG. 8 shows another possible alternative of the invention. In this case, the fastening element 40 clamps directly onto the two flange portions 30, 31. The outer walls 21*a*, 22*a* are equipped with openings 210*a*, 220*a* forming a sufficient passage for the support surfaces of the fastening element. In other words, in the case of a rivet, the head 40*b* of the rivet and the opposing snapped portion 40*c* are directly supported on the surfaces of the flange portions 30, 31. The length of the fastening pin 40*d* is therefore advantageously shortened with respect to the preceding embodiments. This particular arrangement can be applied at the front and/or at the rear of the frame.

Other types of sections are also foreseeable without going beyond the scope of the invention.

It is to be understood that the invention can include many alternatives without going beyond the scope of the invention, whose extent is defined by the following claims.

The instant application is based upon the French Patent Application No. 98 13400, filed on Oct. 20, 1998, the disclosure of which is hereby expressly incorporated by reference thereto in its entirety, and the priority of which is hereby claimed under 35 USC 119.

What is claimed is:

1. An in-line roller skate frame having an inverted generally U-shaped transverse cross-section, said skate frame comprising:

a longitudinally extending main body including two lateral downwardly projecting portions and a transversely extending base, said base including at least one support surface for a toe of a boot and at least one support for a heel of a boot;

two substantially parallel flange portions comprising a structure adapted to receive a plurality of wheels, each of said flange portions being attached to a respective one of said two lateral downwardly projecting portions of said main body, said flange portions being independent attached elements;

two laterally spaced apart grooves, each of said grooves being defined by respective ones of said two lateral downwardly projecting portions and a bracing portion extending transversely between said two grooves, each of said two lateral downwardly projecting portions comprising a respective outer wall of said main body, and each of said two grooves serving as a housing for a respective one of said flange portions;

each of said outer walls of said lateral downwardly projecting portions, each of said flange portions, and said bracing portion having a respective coaxial hole, thereby forming a series of co-axial holes;

a single fastening element extending through said coaxial holes from within a hole of one of said two flange portions to within a hole of a second of said two flange portions.

2. An in-line roller skate frame according to claim 1, wherein:

said series of coaxial holes comprise a first series of co-axial holes positioned at a front zone of said frame;

each of said outer walls of said lateral downwardly projecting portions, each of said flange portions, and said bracing portion having a second respective coaxial hole, thereby forming a second series of co-axial holes positioned at a rear zone of said frame; and a second fastening element extending through said second series of coaxial holes from one of said two flange portions to a second of said two flange portions.

3. An in-line roller skate frame according to claim 1, wherein:

said bracing portion comprises only a single hole of said series of co-axial holes.

4. An in-line roller skate frame according to claim 1, wherein:

said bracing portion comprises a single transversely centrally positioned bracing portion extending transversely between said two grooves.

5. An in-line roller skate frame according to claim 1, wherein:

each of said flange portions comprises a front zone and a rear zone respectively joined to said lateral downwardly projecting portions by a pair of front grooves and a pair of rear grooves, respectively.

6. An in-line roller skate frame according to claim 5, wherein:

said front zone and said rear zone of each of said flange portions are attached by two longitudinally spaced apart fastening elements, each of said fastening elements having a pin portion simultaneously serving to link said front zones and said rear zones of said flange portions.

7. An in-line roller skate frame according to claim 1, wherein:

said main body comprises a longitudinally extending arc-shaped intermediate portion connecting said two support surfaces.

8. An in-line roller skate frame according to claim 1, wherein:

said main body and said flange portions are made of materials of different types having different mechanical properties.

9. An in-line roller skate frame according to claim 8, wherein:

said main body is formed of a hard plastic material produced by injection molding.

10. An in-line roller skate frame according to claim 8, wherein:

said flange portions are formed of cut and drilled metal plates.

11. An in-line roller skate frame according to claim 1, wherein:

said support surfaces comprise means for locking the boot to the frame, said locking mechanisms being detachable.

12. An in-line roller skate frame according to claim 1, wherein:

said flange portions are equipped with a series of longitudinally aligned holes to be used for mounting the wheels.

13. An in-line roller skate frame according to claim 1, wherein:

said fastening element comprises a permanent fastening element.

14. An in-line roller skate frame according to claim 13, wherein:

said permanent fastening element comprises a rivet.

15. An in-line roller skate frame according to claim 1, wherein:

said fastening element comprises a detachable fastening element.

16. An in-line roller skate frame according to claim 15, wherein:

said fastening element comprises a screw.

17. An in-line roller skate frame according to claim 1, wherein:

said two lateral downwardly projecting portions have respective external walls;

said fastening element is supported on said external walls.

18. An in-line roller skate frame according to claim 17, wherein:

said fastening element comprises an intermediate pin portion and enlarged ends, said fastening element extending through enlarged openings in said external walls, said enlarged ends being directly supported on said flange portions.

19. An in-line roller skate frame according to claim 1 in combination with boot affixed to said frame and a series of wheels rotatably secured to said frame.

20. An in-line roller skate frame comprising:

two substantially parallel longitudinally and vertically extending flange portions, said flange portions being transversely spaced apart, said flange portions being configured to have a plurality of wheels rotatably secured therebetween;

a body portion comprising at least two laterally spaced apart longitudinally extending downwardly open grooves, said two grooves being defined by two respective downwardly projecting lateral portions and a transversely centrally positioned bracing portion, each of said two lateral portions comprising a respective outer wall of said body portion, said body portion comprising a front end area for supporting a front end of a boot and a rear end area, unitary with said front end area, for supporting a rear end of a boot;

at least a part of each of said flange portions being housed in a respective one of said two grooves;

each of said lateral portions, each of said flange portions, and said bracing portion having a respective coaxial hole, thereby forming a series of co-axial holes; and a single fastening element extending through all of said coaxial holes to secure together said lateral portions, said flange portions and said bracing portion of the frame.

21. An in-line roller skate frame according to claim 20, wherein:

said series of coaxial holes comprise a first series of co-axial holes positioned at said front end area;

said bracing portion comprises a front bracing portion at said front end area of said body, said body portion further comprising a rear bracing portion at said rear end area of said body;

each of said lateral potions, each of said flange portions, and said rear bracing portion having a respective coaxial hole, thereby forming a second series of co-axial holes positioned at said rear end area; and a second fastening element extending through said second series of coaxial holes from one of said two flange portions to a second of said two flange portions.

22. An in-line roller skate frame according to claim 20, wherein:

said bracing portion comprises only a single hole of said series of co-axial holes.

23. An in-line roller skate frame according to claim 20, wherein:

said body portion comprises a longitudinally extending curved shape having a raised intermediate portion.

24. An in-line roller skate frame according to claim 20, wherein:

said body portion and said flange portions are made of materials of different types having different mechanical properties.

25. An in-line roller skate frame according to claim 24, wherein:

said body portion is made of a hard plastic material produced by injection molding and said flange portions are made from cut and drilled metal plates.

26. An in-line roller skate frame according to claim 20, wherein:

said fastening element comprises a permanent fastening element.

27. An in-line roller skate frame according to claim 26, wherein:

said permanent fastening element comprises a rivet.

28. An in-line roller skate frame according to claim 20, wherein:

said fastening element comprises a detachable fastening element.

29. An in-line roller skate frame according to claim 20, wherein:

said fastening element comprises a screw.

30. An in-line roller skate frame according to claim 20, wherein:

each said part of each of said flanges is flat.

31. An in-line roller skate comprising:

two substantially parallel longitudinally and vertically extending flange portions, said flange portions being transversely spaced apart, a plurality of wheels rotatably secured between said flange portions;

a body portion comprising at least two laterally spaced apart longitudinally extending downwardly open grooves, said two grooves being defined by two respective downwardly projecting lateral portions and a transversely centrally positioned bracing portion, each of said two lateral portions comprising a respective outer wall of said body portion, said body portion comprising a front end area for supporting a front end of a boot and a rear end area, unitary with said front end area, for supporting a rear end of a boot;

at least a part of each of said flange portions being housed in a respective one of said two grooves;

each of said lateral portions, each of said flange portions, and said bracing portion having a respective coaxial hole, thereby forming a series of co-axial holes;

a single fastening element extending through all of said coaxial holes to secure together said lateral portions, said flange portions and said bracing portion of the frame; and a boot extending upwardly from said body portion.

32. An in-line roller skate frame according to claim 31, wherein:

each said part of each of said flanges is flat.

* * * * *